US008190336B2

(12) United States Patent
Verkuilen et al.

(10) Patent No.: US 8,190,336 B2
(45) Date of Patent: May 29, 2012

(54) MACHINE WITH CUSTOMIZED IMPLEMENT CONTROL

(75) Inventors: Michael Todd Verkuilen, Metamora, IL (US); Jeffrey Lee Kuehn, Metamora, IL (US); Brian Mintah, Washington, IL (US); Benjamin Yoo, Itasca, IL (US)

(73) Assignee: Caterpillar Inc., Peoria, IL (US)

( * ) Notice: Subject to any disclaimer, the term of this patent is extended or adjusted under 35 U.S.C. 154(b) by 679 days.

(21) Appl. No.: 12/219,178

(22) Filed: Jul. 17, 2008

(65) Prior Publication Data

US 2010/0017074 A1 Jan. 21, 2010

(51) Int. Cl.
*G06F 7/70* (2006.01)

(52) U.S. Cl. ..... 701/50; 37/348

(58) Field of Classification Search ..... 701/50; 37/348

See application file for complete search history.

(56) References Cited

U.S. PATENT DOCUMENTS

| | | | | |
|---|---|---|---|---|
| 3,703,931 | A | | 11/1972 | Page et al. |
| 4,757,454 | A | | 7/1988 | Hisatake et al. |
| 4,853,859 | A | | 8/1989 | Morita et al. |
| 5,065,326 | A | | 11/1991 | Sahm |
| 5,105,895 | A | | 4/1992 | Kyrtsos |
| 5,493,798 | A | | 2/1996 | Rocke et al. |
| 5,714,719 | A | | 2/1998 | Otsuka et al. |
| 5,794,369 | A | | 8/1998 | Lee et al. |
| 5,826,666 | A | | 10/1998 | Tozawa et al. |
| 5,890,303 | A | * | 4/1999 | Ishikawa et al. ..... 37/348 |
| 5,950,428 | A | | 9/1999 | Nam et al. |
| 5,953,838 | A | | 9/1999 | Steenwyk |
| 5,974,352 | A | | 10/1999 | Shull |
| 6,055,851 | A | | 5/2000 | Tanaka et al. |
| 6,070,539 | A | * | 6/2000 | Flamme et al. ..... 111/177 |
| 6,108,948 | A | | 8/2000 | Tozawa et al. |
| 6,204,772 | B1 | | 3/2001 | DeMay et al. |
| 6,205,687 | B1 | | 3/2001 | Rocke |
| 6,339,737 | B1 | | 1/2002 | Yoshimura et al. |
| 6,618,658 | B1 | | 9/2003 | Kagoshima et al. |
| 6,751,541 | B2 | | 6/2004 | Komatsu et al. |
| 6,879,969 | B2 | | 4/2005 | Engström et al. |
| 6,907,336 | B2 | | 6/2005 | Gray et al. |
| 6,915,599 | B2 | | 7/2005 | Lohnes et al. |
| 7,069,131 | B2 | | 6/2006 | Kim |
| 7,124,056 | B2 | | 10/2006 | Shibamori et al. |
| 7,222,051 | B2 | | 5/2007 | Shibata et al. |
| 7,276,669 | B2 | | 10/2007 | Dahl et al. |
| 2003/0037465 | A1 | | 2/2003 | Toji et al. |
| 2003/0089002 | A1 | | 5/2003 | Bares et al. |

(Continued)

OTHER PUBLICATIONS

Brian Mintah et al., Machine With Automatic Operating Mode Determination, U.S. Appl. No. 12/081,646, filed Apr. 18, 2008, 31 pages.

*Primary Examiner* — Michael Carone
*Assistant Examiner* — Samir Abdosh
(74) *Attorney, Agent, or Firm* — Finnegan, Henderson, Farabow, Garrett & Dunner LLP

(57) ABSTRACT

A method is provided for operating a machine. The method includes receiving data relating to a current state of multiple parameters. The method also includes determining a parameter signature for each parameter of the multiple parameters based on the received data. In addition, the method includes comparing each parameter signature to reference data to determine which operating modes of the machine are indicated by each parameter signature. The method further includes adjusting one or more components of an implement control system according to the operating mode indicated by a threshold number of parameter signatures.

14 Claims, 10 Drawing Sheets

U.S. PATENT DOCUMENTS

2004/0060205 A1 4/2004 Yoshino
2004/0117094 A1 6/2004 Colburn
2004/0117095 A1 6/2004 Colburn et al.
2005/0044753 A1 3/2005 Lohnes et al.
2005/0283295 A1* 12/2005 Normann ..... 701/50
2006/0123672 A1 6/2006 Ichimura et al.
2006/0129280 A1* 6/2006 Thomas et al. ..... 700/275
2007/0050115 A1* 3/2007 Discenzo et al. ..... 701/50
2007/0239328 A1 10/2007 Saposnik
2009/0265047 A1 10/2009 Mintah et al.

* cited by examiner

232

| PARAMETERS | OPERATING MODES | | | | | | |
|---|---|---|---|---|---|---|---|
| | TRUCK LOADING MODE | TRENCHING MODE | SLOPE FINISH MODE | TAMPING MODE | BOOM UP STICK RELIEF MODE | STICK SHAKE MODE | STICK DIRECTIONAL CHANGE MODE |
| FIRST OPERATOR INPUT DEVICE DISPLACEMENT | | | | | | | X |
| SECOND OPERATOR INPUT DEVICE DISPLACEMENT | | | | | O | | O |
| THIRD OPERATOR INPUT DEVICE DISPLACEMENT | | | | | X | | |
| FOURTH OPERATOR INPUT DEVICE DISPLACEMENT | | | | | | X | |
| PRESSURE DIFFERENTIAL FOR HYDRAULIC CYLINDER 36 | | | X | | | | |
| PRESSURE DIFFERENTIAL FOR HYDRAULIC CYLINDER 42 | | | O | | O | | |
| PRESSURE DIFFERENTIAL FOR HYDRAULIC CYLINDER 44 | | | | | X | | |
| PRESSURE DIFFERENTIAL FOR SWING MOTOR 24 | | | | | X | | |
| TOTAL | 0 | 0 | 1 | 0 | 3 | 1 | 1 |

FIG. 8

MACHINE WITH CUSTOMIZED IMPLEMENT CONTROL

TECHNICAL FIELD

The present disclosure is directed to a machine and, more particularly, to a machine with customized implement control.

BACKGROUND

Machines such as, for example, excavators, wheel loaders, dozers, backhoes, dump trucks, and other heavy equipment are used to perform many tasks such as, for example, loading a bucket, digging a trench, compacting soil, etc. Each of these tasks imposes unique demands on various systems of the machine. For example, an optimal distribution of hydraulic fluid among various components of the machine during a bucket loading operation may be different from an optimal distribution of hydraulic fluid during a trench digging operation. In addition, an optimal sensitivity for operator input devices during a bucket loading operation may be different from an optimal sensitivity for operator input devices during a trench digging operation. If a machine were able to automatically determine its current operating mode, it might be able to adjust the various systems for optimal performance.

One example of a machine that identifies a current operating mode and adjusts various systems for optimal performance can be found in U.S. Patent Publication No. US2005/0283295 (the '295 publication) by Normann on Dec. 22, 2005. The '295 publication discloses a skid steer loader having an operating mode identification system. The system receives data related to a current operating mode and creates a current application signature. The identification system compares this current application signature to stored application signatures relating to various operating modes of the skid steer loader. The stored signature that most closely matches the current application signature is determined to be the current operating mode, and the system adjusts various machine parameters according to the operating mode identification.

Although the system disclosed in the '295 publication may identify a current operating mode of the machine, the accuracy of the system may be limited. In particular, only one current application signature is calculated from the current data. However, under some conditions, data from different machine parameters may identify different operating modes as the current operating mode. Calculating only one application signature from the current data may include conflicting data that may taint the comparison and may cause the system to identify the wrong operating mode. If the wrong operating mode is identified, adjusting the parameters of the machine accordingly may adversely affect the operation of the machine.

The disclosed system is directed to overcoming one or more of the problems set forth above.

SUMMARY

In one aspect, the present disclosure is directed toward a method for operating a machine. The method includes receiving data relating to a current state of multiple parameters. The method also includes determining a parameter signature for each parameter of the multiple parameters based on the received data. In addition, the method includes comparing each parameter signature to reference data to determine which operating modes of the machine are indicated by each parameter signature. The method further includes adjusting one or more components of an implement control system according to the operating mode indicated by a threshold number of parameter signatures.

Consistent with a further aspect of the disclosure, a method is provided for operating a machine. The method includes receiving data relating to a current state of multiple parameters. The method also includes determining a parameter signature for each parameter of the multiple parameters based on the received data. In addition, the method includes comparing each parameter signature to reference data to determine which operating modes of the machine are indicated by each parameter signature. The method further includes determining a current state of one or more factors that affect the operation of the machine, the factors being different from the parameters associated with the parameter signatures. Additionally, the method includes adjusting one or more components of an implement control system according to the current state of the one or more factors and the operating mode indicated by a threshold number of parameter signatures.

BRIEF DESCRIPTION OF THE DRAWINGS

FIG. 8 is a data table listing the result of an exemplary machine operating mode determination analysis performed by the processing device of the implement control system of FIG. 3;

DETAILED DESCRIPTION

Figure 1:
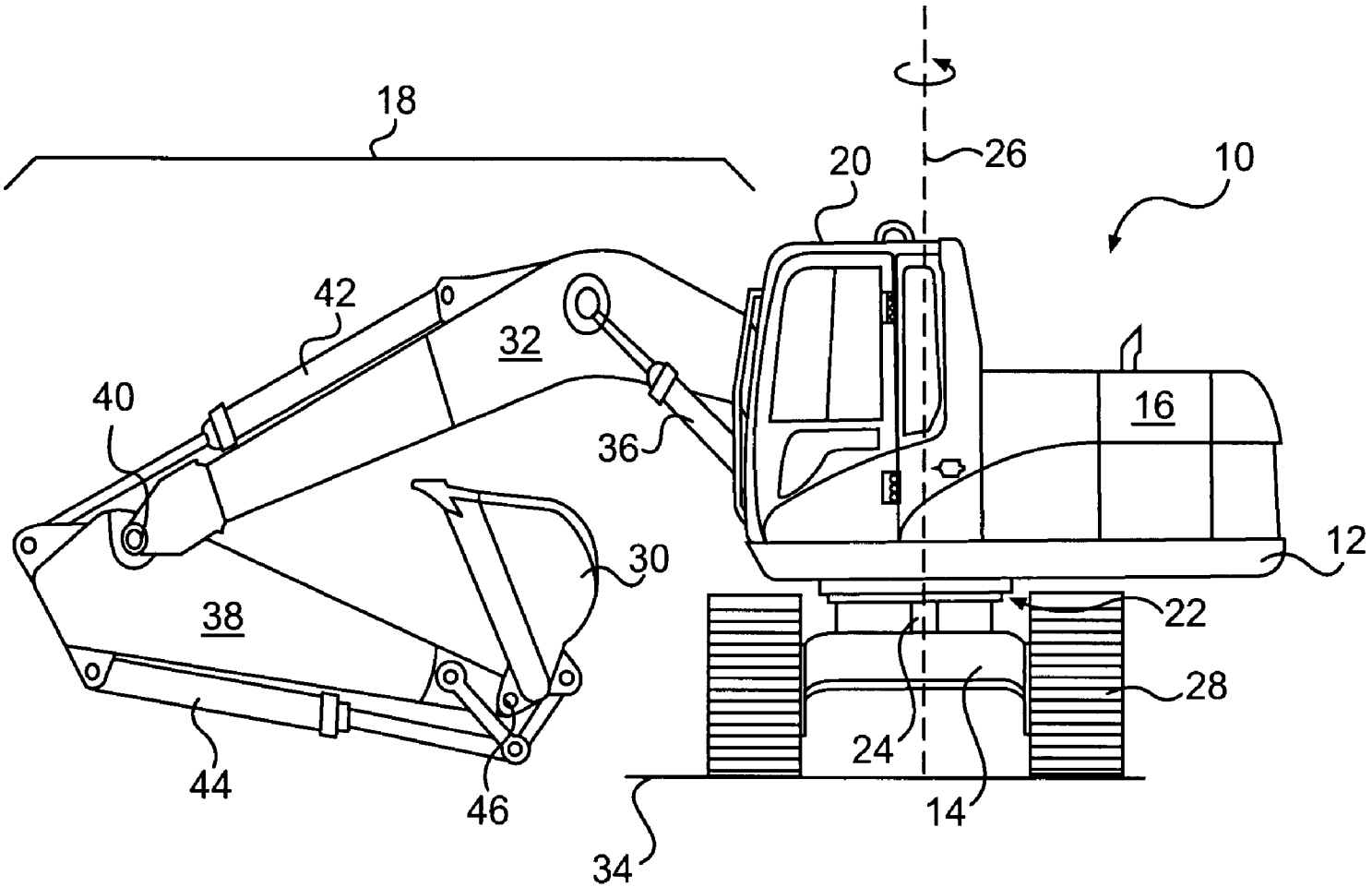
FIG. 1 is a diagrammatic illustration of an exemplary disclosed machine.

FIG. 1 illustrates an exemplary machine 10 having multiple systems and components that cooperate to accomplish a task. Machine 10 may embody a fixed or mobile machine that performs some type of operation associated with an industry such as mining, construction, farming, transportation, or any other industry known in the art. For example, machine 10 may be an earth moving machine such as an excavator, a dozer, a loader, a backhoe, a motor grader, a haul truck, or any other earth moving machine. Machine 10 as depicted in the illustrative FIG. 1 may include a platform 12, an undercarriage 14 to which platform 12 may be rotatably coupled, a power source 16, an implement system 18 coupled to platform 12, and an operator station 20 for operator control of machine 10.

Platform 12 may be a structural member supporting operator station 20 and may be coupled to undercarriage 14 via a vertical pivot 22. A hydraulic swing motor 24 may be used to rotate platform 12 relative to undercarriage 14 about an axis 26 of vertical pivot 22. In addition, undercarriage 14 may be a structural support for one or more traction devices 28. Traction devices 28 may include tracks located on each side of machine 10 configured to allow translational motion of machine 10 across a work surface. Alternatively, traction devices 28 may include wheels, belts, or other traction devices known in the art.

Power source 16 may provide power for the operation of machine 10. Power source 16 may embody a combustion engine, such as a diesel engine, a gasoline engine, a gaseous fuel powered engine (e.g., a natural gas engine), or any other type of combustion engine known in the art. Power source 16 may alternatively embody a non-combustion source of power, such as a fuel cell or other power storage device coupled to a motor.

Implement system 18 may include a linkage structure acted on by fluid actuators to move a tool 30. Specifically, implement system 18 may include a boom member 32 pivotally connected to platform 12 of machine 10. In addition, implement system 18 may be vertically pivotal about a horizontal axis (not shown) relative to a surface 34 by a pair of adjacent, double-acting, hydraulic cylinders 36 (only one shown in FIG. 1). Implement system 18 may also include a stick member 38 vertically pivotal about a horizontal axis 40 relative to surface 34 by a single, double-acting, hydraulic cylinder 42. Implement system 18 may further include a single, double-acting, hydraulic cylinder 44 operatively connected to tool 30 to pivot tool 30 vertically about a horizontal pivot axis 46. Stick member 38 may pivotally connect boom member 32 to tool 30 by way of axes 40 and 46.

Numerous different tools 30 may be attachable to a single machine 10 and controllable via operator station 20. Tool 30 may include any device used to perform a particular task such as, for example, a bucket, a fork arrangement, a blade, a shovel, a ripper, a dump bed, a broom, a snow blower, a propelling device, a cutting device, a grasping device, or any other task-performing device known in the art. Although connected in the embodiment of FIG. 1 to pivot relative to machine 10, tool 30 may alternatively or additionally rotate, slide, swing, lift, or move in any other manner known in the art.

Figure 2:
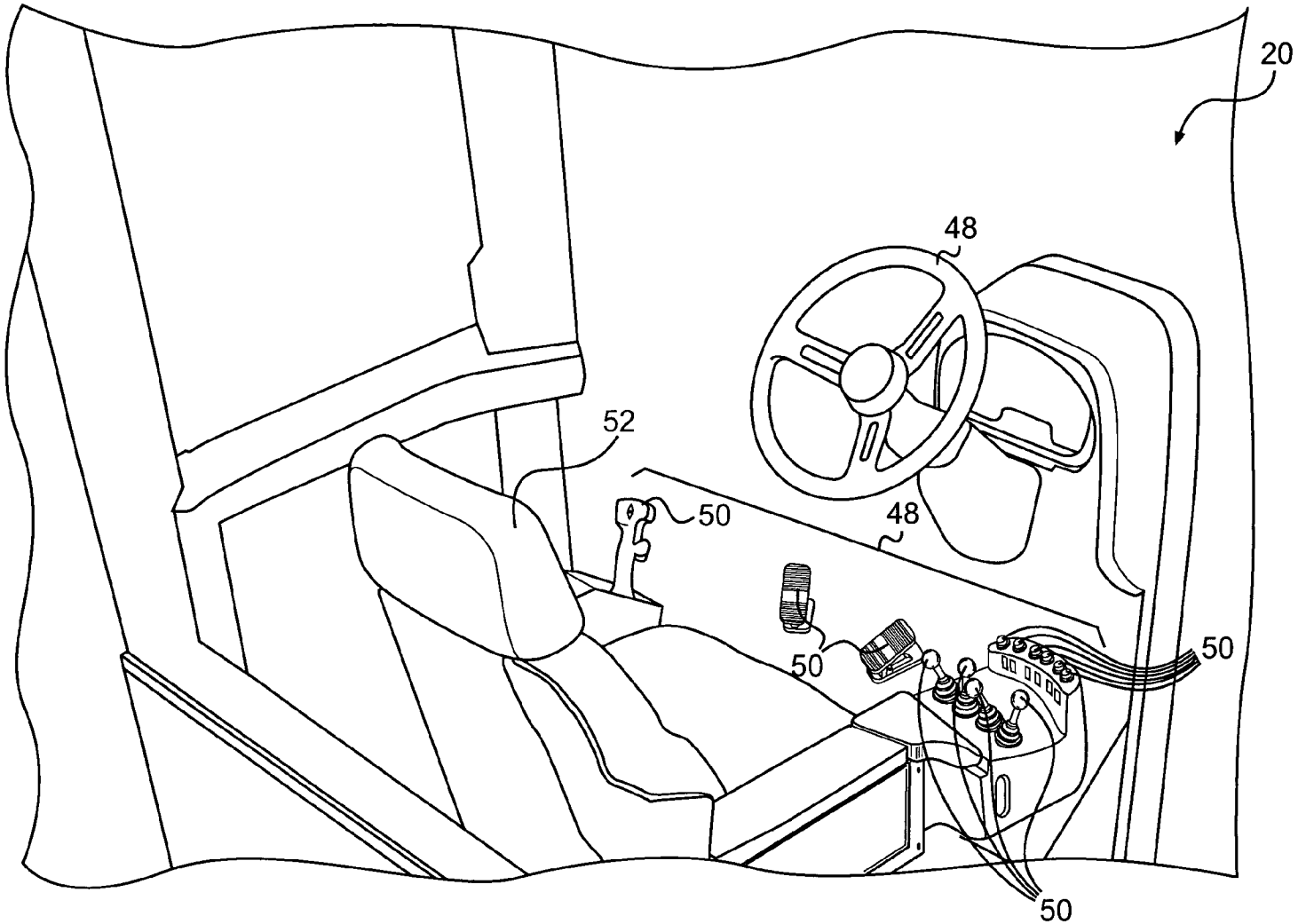
FIG. 2 is a pictorial illustration of an exemplary disclosed operator station for use with the machine of FIG. 1.

As illustrated in FIG. 2, operator station 20 may include an operator interface 48 that receives input from a machine operator indicative of a desired machine maneuver. Specifically, operator station 20 may include one or more operator input devices 50 located proximate an operator seat 52 such as, for example, a multi-axis joystick, wheels, knobs, push-pull devices, switches, pedals, and other operator interface devices known in the art. It is contemplated that a single operator input device 50 may actuate hydraulic cylinders 36, 42, 44, and swing motor 24 to position and/or orient tool 30 and produce an interface device position signal indicative of a desired movement of tool 30. Alternatively, hydraulic cylinders 36, 42, 44, and swing motor 24 may each be associated with a unique operator input device 50.

Figure 3:
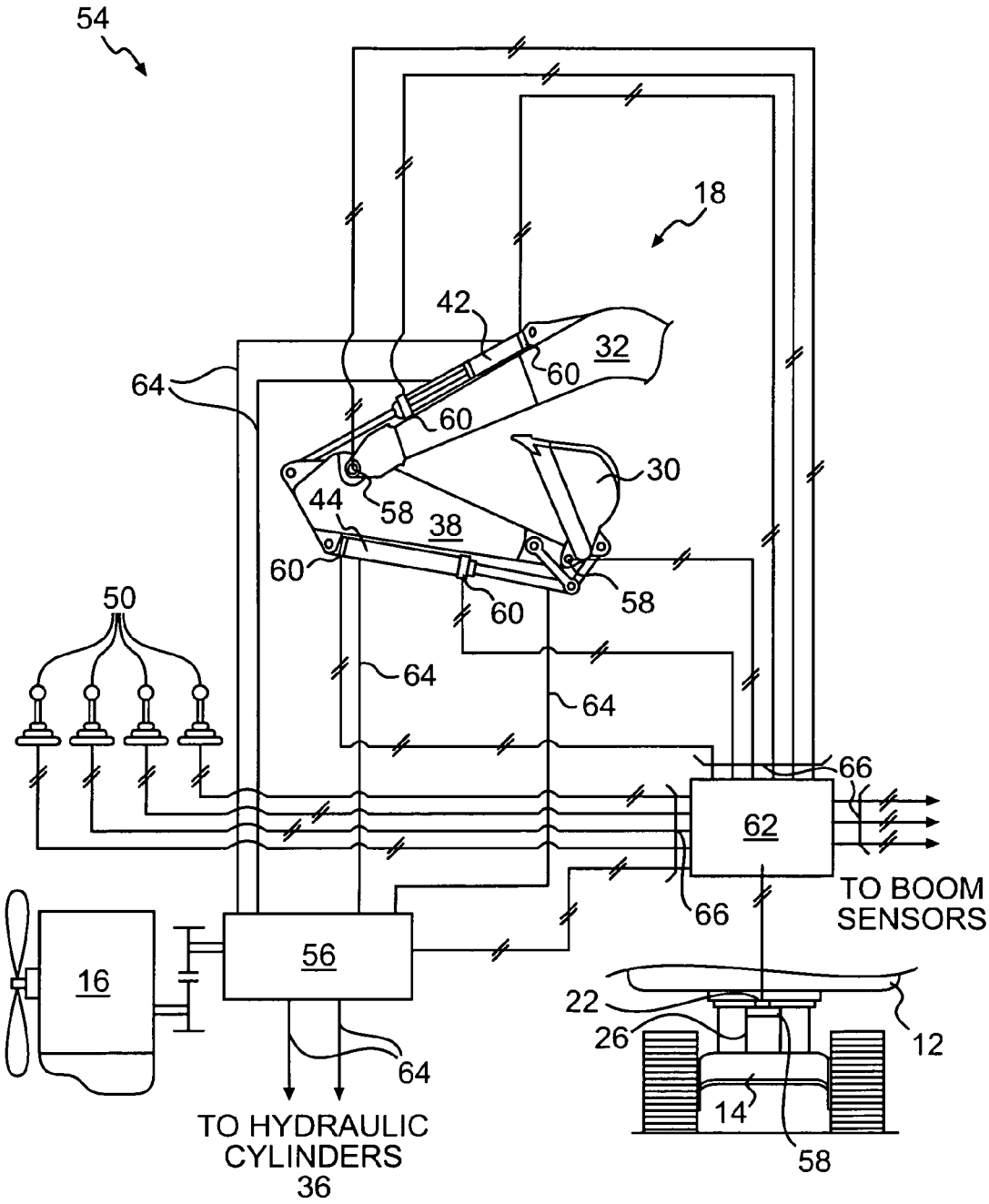
FIG. 3 is a schematic and diagrammatic illustration of an exemplary disclosed implement control system for use with the machine of FIG. 1.

As illustrated in FIG. 3, machine 10 may include an implement control system 54 for regulating the operation of implement system 18 according to a current operating mode of machine 10, which may be determined by analyzing various machine parameters. The current operating mode may be, for example, loading a truck, trenching, finishing a slope of a surface, tamping, boom up stick relief, stick shake, stick directional change or any other operation that may be performed by machine 10. Implement control system 54 may also regulate the operation of implement system 18 according to a current state of additional factors affecting the operation of machine 10. The additional factors may include, for example, the geographic location of machine 10, the type of tool 30 being utilized by machine 10, the properties of material being handled by machine 10 (e.g., compact or loose soil), and any other factor that may be used to adjust implement control system 54 for improving the efficiency of machine 10. Implement control system 54 may include operator input devices 50, a hydraulic system 56, one or more state sensors 58, one or more pressure sensors 60, and a processing device 62. It is contemplated that implement control system 54 may include additional sensors located throughout machine 10, if desired.

Hydraulic system 56 may provide pressurized fluid to hydraulic cylinders 36, 42, 44. Specifically, hydraulic system 56 may include a pump (not shown) and a plurality of control valves (not shown). The pump (powered by a rotational output of power source 16) may pressurize a hydraulic fluid that may be communicated to the plurality of control valves. The plurality of control valves may selectively supply the pressurized fluid to hydraulic cylinders 36, 42, 44. It is contemplated that hydraulic system 56 may include additional or different components, such as, for example, accumulators, check valves, pressure relief or makeup valves, pressure compensating elements, restrictive orifices, and other hydraulic components known in the art.

State sensors 58 may be angle sensing devices located near a pivot joint of boom member 32 (not shown), horizontal axis 40, and/or pivot axis 46. State sensors 58 may include rotary encoders, potentiometers, or other angle or position sensing devices (e.g., state sensor 58 may be located on a linear actuator and may be configured to determine a joint angle using an actuator position). Output signals of state sensors 58 may be used to determine a state of implement system 18, such as, for example, a position, a velocity, an acceleration, an angle, an angular velocity, or an angular acceleration of boom member 32, stick member 38, and tool 30. One or more state sensors 58 may additionally be located near vertical pivot 22 and may measure an angle, an angular velocity, or an angular acceleration of platform 12 relative to undercarriage 14.

Pressure sensors 60 may transmit a signal usable to determine a current hydraulic pressure differential between the chambers of hydraulic cylinders 36, 42, 44, and swing motor 24, and/or boom member 32, stick member 38, and tool 30. In addition, pressure sensors 60 may be located to measure the pressure of the pressurized fluid within or supplied to the chambers of hydraulic cylinders 36, 42, 44, and swing motor 24.

Processing device 62 may monitor the performance of machine 10 and its components. In addition, processing device 62 may communicate via one or more communication lines 66 (or wirelessly) with state sensors 58, pressure sensors 60, and operator input devices 50. It is contemplated that processing device 62 may also communicate with power source 16 and/or other components of machine 10. Processing device 62 may embody a single microprocessor or multiple microprocessors. Numerous commercially available microprocessors may be configured to perform the functions of processing device 62, and it should be appreciated that processing device 62 may readily embody a general machine microprocessor capable of monitoring numerous machine functions. Processing device 62 may include a memory, a secondary storage device, a processor, and any other components for running an application. Various other circuits may be associated with processing device 62, such as, for example, power supply circuitry, signal conditioning circuitry, data acquisition circuitry, signal output circuitry, signal amplification circuitry, and other types of circuitry known in the art.

Processing device 62 may receive data from sensors 58, 60 and operator input devices 50 relating to a current status of various machine parameters. For example, processing device 62 may receive data relating to the displacements of operator input devices 50 and the hydraulic pressure differences associated with the hydraulic chambers of each hydraulic cylinder. As the data is received by processing device 62, a signature based on the received data may be determined for each parameter. Each parameter signature may be indicative of a current state of the associated parameter. In addition, these parameter signatures may be compared to stored reference signatures relating to different operating modes such as, for example, the reference signatures illustrated in FIGS. 4 and 5.

Figure 4:
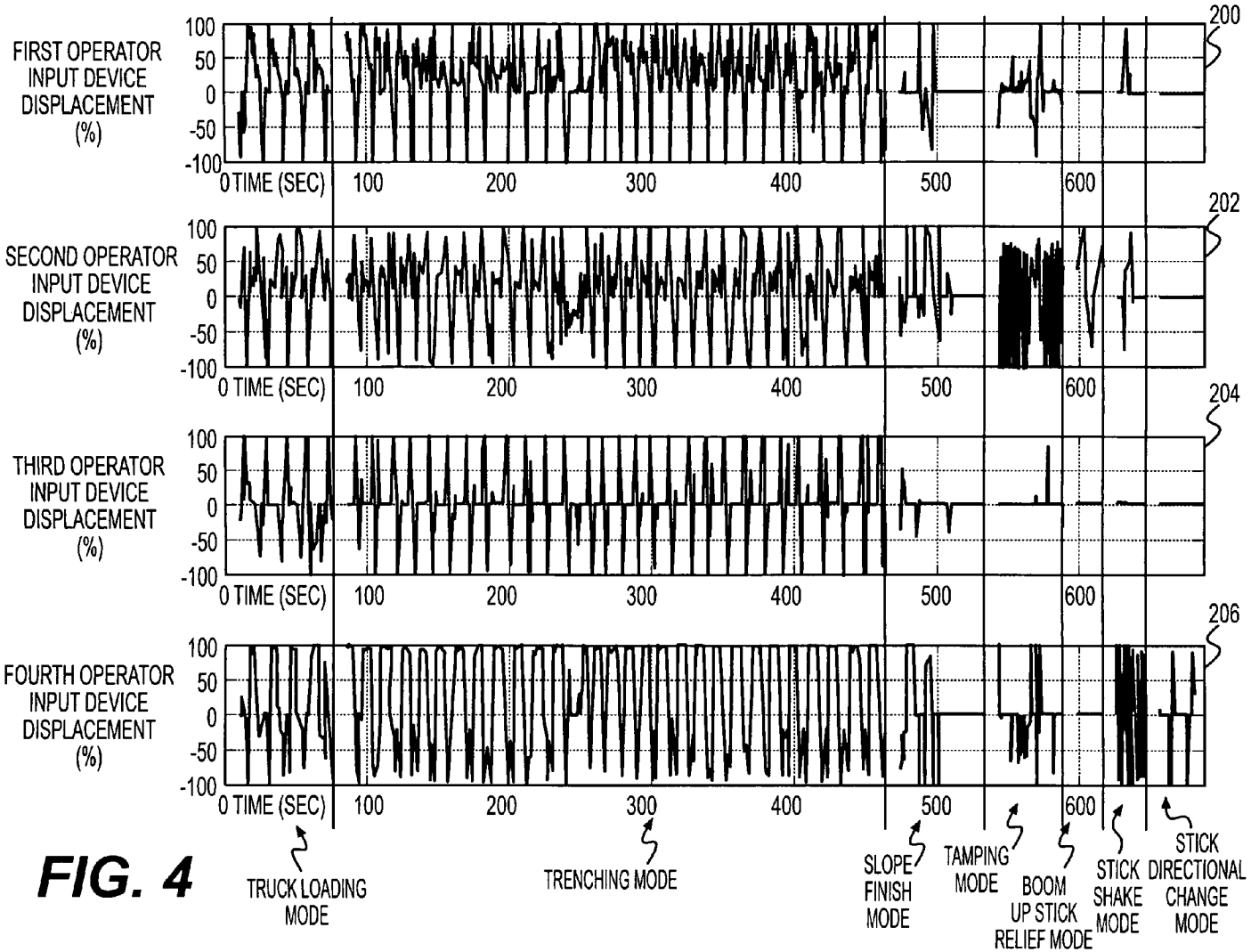
FIG. 4 illustrates exemplary graphical representations of reference data stored in a processing device of the implement control system of FIG. 3.

FIG. 4 illustrates exemplary graphical representations of reference signatures relating to the displacements of operator input devices 50. A graphical representation 200 may represent a first operator input device displacement used to manipulate boom member 32. In addition, a graphical representation 202 may represent a second operator input device displacement used to manipulate tool 30. Additionally, a graphical representation 204 may represent a third operator input device displacement used to manipulate stick member 38. Furthermore, a graphical representation 206 may represent a fourth operator input device displacement used to manipulate swing motor 24.

Graphical representations 200, 202, 204, and 206 may each include an x-axis representing a duration of time that may elapse during the data retrieval process and a y-axis representing a displacement of the operator input devices 50. For example, 100 may represent a displacement of 100% in the forward direction, −100 may represent a displacement of 100% in the reverse direction, and 0 may represent a neutral position. In addition, graphical representations 200, 202, 204, and 206 may be divided into sections that represent a particular mode in which machine 10 may be operating during a data collection event. For example, graphical representations 200, 202, 204, and 206 may be divided into sections relating to a truck loading mode, a trenching mode, a slope finishing mode, a tamping mode, a boom up stick relief mode, a stick shake mode, and a stick directional change mode. As can be seen, the data included in each mode may have a unique signature against which current data may be compared when determining the current operating mode of machine 10.

Figure 5:
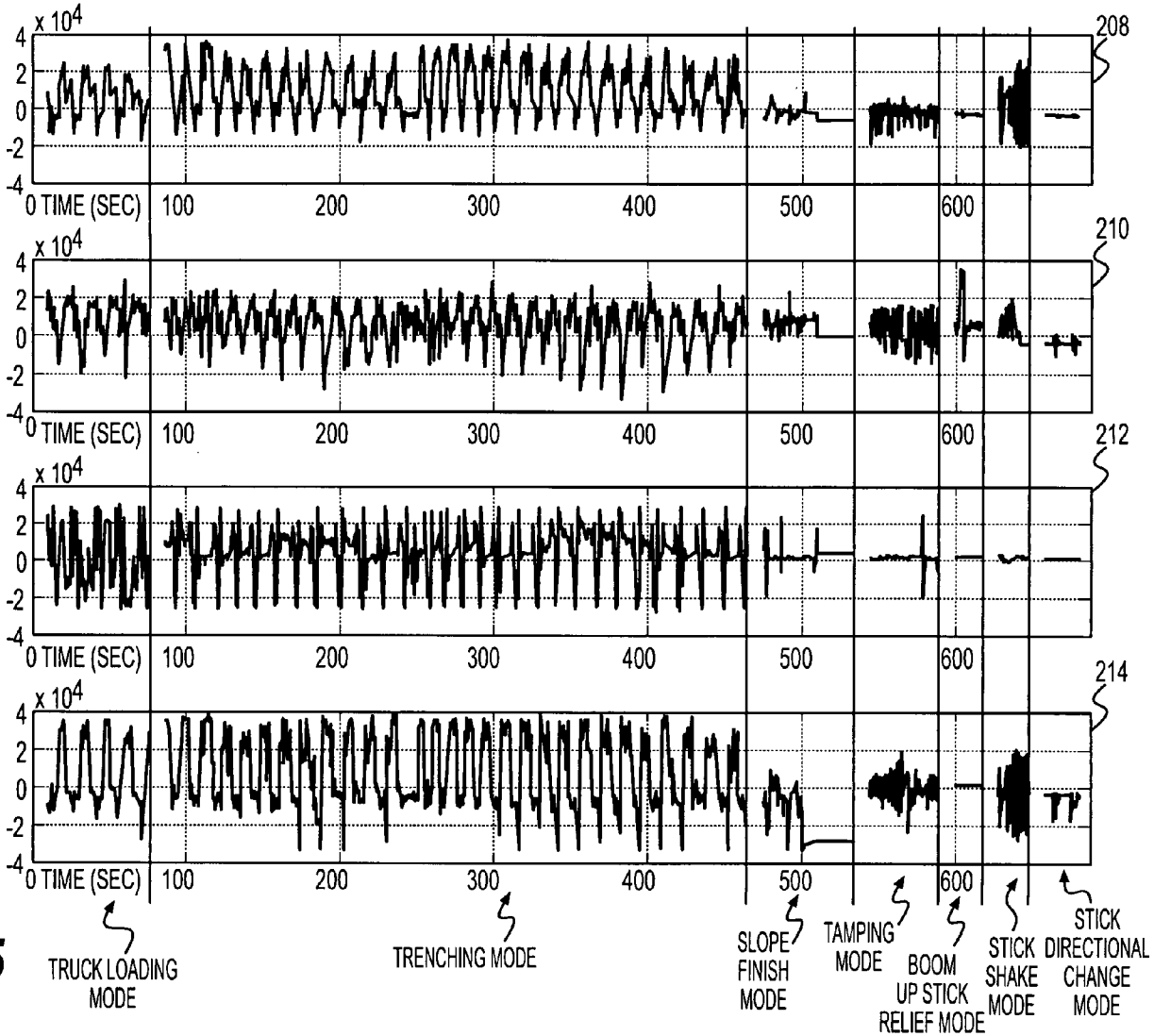
FIG. 5 illustrates additional exemplary graphical representations of reference data stored in the processing device of the implement control system of FIG. 3.

FIG. 5 illustrates exemplary graphical representations relating to pressure differences between the hydraulic chambers of hydraulic cylinders 36, 42, 44, and hydraulic swing motor 24. A graphical representation 208 may represent a pressure difference between the hydraulic chambers of hydraulic cylinders 36. In addition, a graphical representation 210 may represent a pressure difference between the hydraulic chambers of hydraulic cylinder 42. Additionally, a graphical representation 212 may represent a pressure difference between the hydraulic chambers of hydraulic cylinder 44. Furthermore, a graphical representation 214 may represent a pressure difference between the hydraulic chambers of swing motor 24.

Graphical representations 208, 210, 212, and 214 may each include an x-axis representing a duration of time that may elapse during the data retrieval process and a y-axis representing the sensed pressure difference. In addition, graphical representations 208, 210, 212, and 214 may be divided into sections that represent a particular mode in which machine 10 may be operating during a data collection event. For example, graphical representations 208, 210, 212, and 214 may be divided into sections relating to a truck loading mode, a trenching mode, a slope finishing mode, a tamping mode, a boom up stick relief mode, a stick shake mode, and a stick directional change mode. As can be seen, the data included in each mode may have a unique signature against which current data may be compared when determining the current operating mode of machine 10.

The comparisons between the parameter signatures and the reference signatures may be used to determine which operating modes may be indicated by each parameter signature. In particular, the operating mode associated with the reference signature having the closest correlation with a particular parameter signature may be the operating mode indicated by that parameter signature. Each comparison may use any method capable of determining which reference signature of the selected graphical representation most closely matches the parameter signature. In one exemplary embodiment, the comparison may be made by performing a root mean square (RMS) error analysis.

Figure 6:
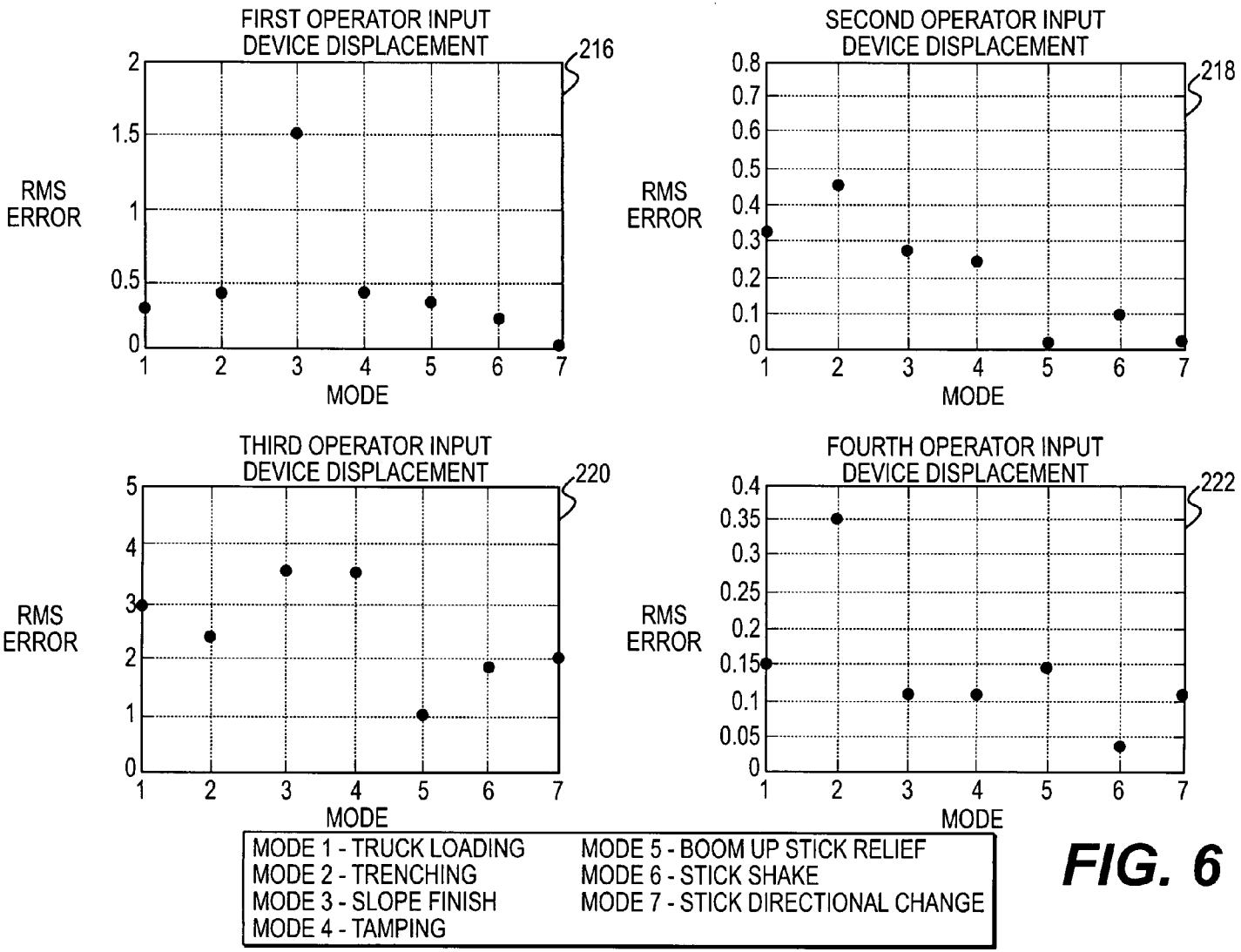
FIG. 6 illustrates exemplary graphical representations of data comparisons performed by the processing device of the implement control system of FIG. 3.
Figure 7:
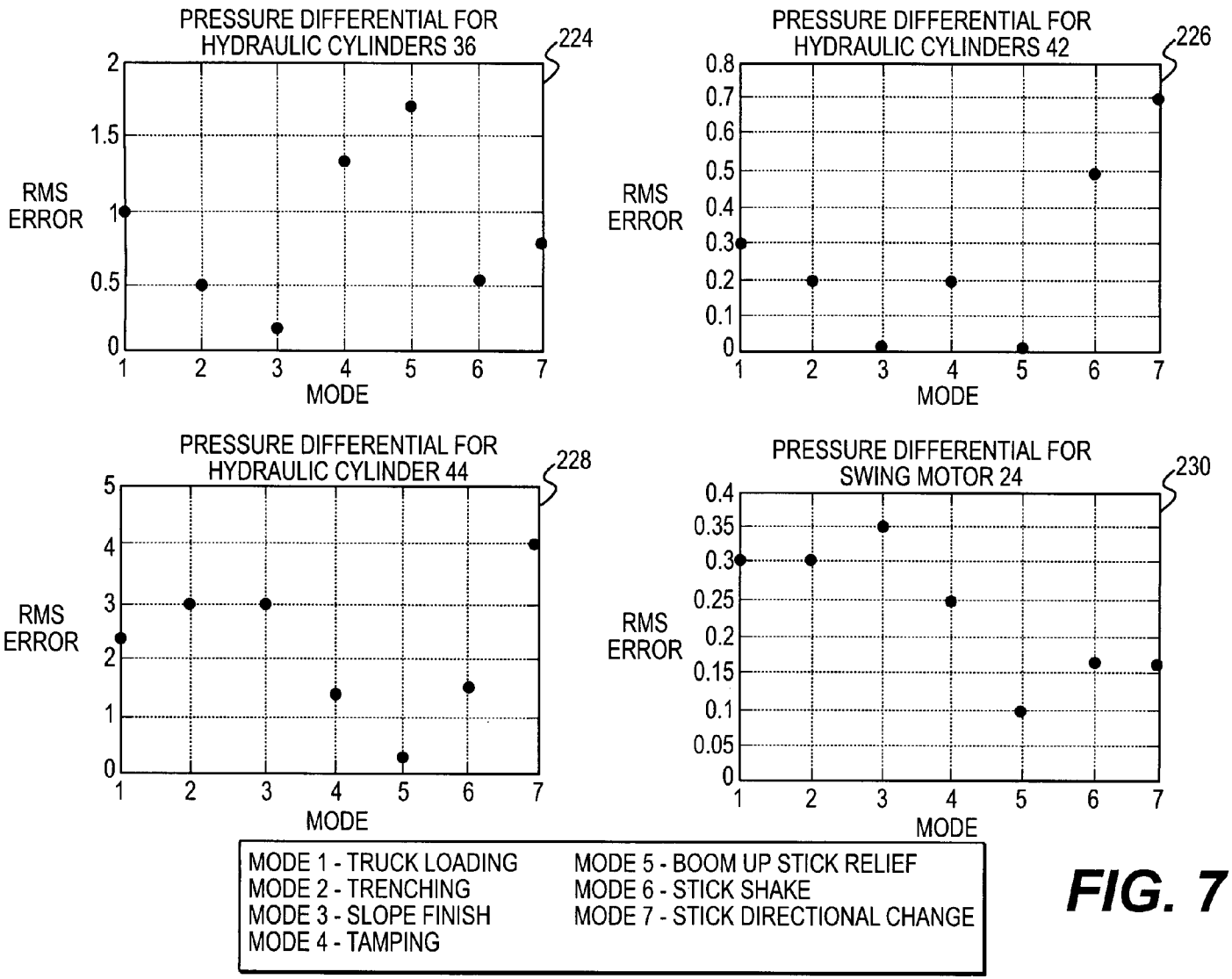
FIG. 7 illustrates additional exemplary graphical representations of data comparisons performed by the processing device of the implement control system of FIG. 3.

FIGS. 6 and 7 illustrate comparisons for various machine parameters utilizing an RMS error analysis. Each comparison may be represented by a chart including an x-axis representing the different operating modes and a y-axis representing the RMS error between the parameter signature and the reference signature. Data points located in each chart may represent how closely each reference signature correlates to the parameter signature. For example, the lower the RMS error value, the closer the correlation may be.

As illustrated in FIG. 6, a chart 216 may represent a comparison between parameter and reference signatures relating to the first operator input device displacement. In chart 216, the correlation (i.e., RMS error) between the parameter signature and the truck loading reference signature (mode 1) of graphical representation 200 may have an RMS error value of 0.25. This comparison may be repeated for each reference signature of graphical representation 200 until data points for each operating mode have been determined. As can be seen, the reference signature having the closest correlation with the parameter signature may be the stick directional change mode reference signature (mode 7), which may have an RMS error value of zero. Therefore, the parameter signature relating to the first operator input device displacement may indicate that machine 10 may be operating in the stick directional change mode.

In addition to chart 216, FIG. 6 illustrates a chart 218 representing a comparison between parameter and reference signatures relating to the second operator input device displacement, a chart 220 representing a comparison between parameter and reference signatures relating to the third operator input device displacement, and a chart 222 representing a comparison between parameter and reference signatures relating to the fourth operator input device displacement. Furthermore, FIG. 7 illustrates a chart 224 representing a comparison between parameter and reference signatures relating the pressure differential between the hydraulic chambers of hydraulic cylinders 36, a chart 226 representing a comparison between parameter and reference signatures relating the pressure differential between the hydraulic chambers of hydraulic cylinder 44, a chart 228 representing a comparison between parameter and reference signatures relating the pressure differential between the hydraulic chambers of hydraulic cylinder 42, and a chart 230 representing a comparison between parameter and reference signatures relating the pressure differential between the hydraulic chambers of swing motor 26.

In some circumstances, comparisons between the reference signatures and the parameter signature may reveal that multiple reference signatures may have an equal correlation with the parameter signature. If such a correlation is determined to be the closest, the parameter signature may indicate more than one operating mode. For example, as can be seen in chart 218, the boom up stick relief and stick directional change modes (modes 5 and 7) may each have an RMS error value of zero, which may be the lowest RMS error value for any of the reference signatures. Therefore, the parameter signature for the second operator input device displacement may indicate more than one operating mode (modes 5 and 7). A parameter signature indicating more than one operating mode may be rendered useless for determining the current operating mode of machine 10 because it may be unclear which operating mode is indicated by the parameter signature. Therefore, parameter signatures indicating multiple operating modes may be omitted from further analysis, and the remaining parameter signatures may be surveyed to determine the current operating mode of machine 10.

FIG. 8 illustrates a table 232, which may summarize the comparison results shown in FIGS. 6 and 7 and may be used to determine the current operating mode of machine 10. An "X" may be used to show the results of the comparisons when a parameter signature indicates a single operating mode. These results may be used to determine the current operating mode of machine 10. In addition, an "O" may be used to show the results of the comparisons when a parameter signature indicates multiple operating modes. These results may be omitted or ignored when determining the current operating mode of machine 10.

The current operating mode of machine 10 may be determined by surveying the results of the signature comparisons marked by an "X". The operating mode indicated by a threshold number of parameter signatures may be the current operating mode of machine 10. Such a threshold may be set as the largest number of parameter signatures, a majority of the parameter signatures, or any number of parameter signatures determined to be appropriate to ascertain the current operating mode of machine 10.

Counting the "X"s in table 232, the boom up stick relief mode may be indicated by three parameter signatures. In addition, the stick shake mode, the stick directional change mode, and the slope finish mode may each be indicated by one parameter signature. Furthermore, none of the parameter signatures may indicate the truck loading mode, the trenching mode, or the tamping mode. If the threshold is set to the largest number of parameter signatures indicating a particular operating mode, the current operating mode may be determined to be the boom up stick relief mode, which may be indicated by three parameter signatures.

The results of the survey of parameter signatures may be different if the threshold is set at a majority of the parameter signatures. Referring to the eight parameter signatures listed in table 232, a majority of the eight parameter signatures may be five. However, it is contemplated that the number of parameter signatures needed for a majority may be reduced if the results of any parameter signatures are omitted from the survey. Because two of the eight parameter signatures listed in table 232 may be omitted from the survey, the number of parameter signatures needed to constitute a majority may be reduced to four. An analysis of the results displayed in table 232 in light of the majority threshold may not indicate a current operating mode because none of the operating modes may be indicated by four or more parameter signatures.

If none of the operating modes are indicated by a greater number of parameter signatures than the threshold number of parameter signatures, the operating mode or operating modes indicated by more parameter signatures than any other operating mode may undergo a supplemental analysis in light of supplemental data. Such supplemental data may be associated with machine parameters not previously utilized for determining the current operating mode. The machine parameters associated with the supplemental data may include, for example, an engine load, manipulations of other operator input devices 50, hydraulic circuit pressures for operating modes utilizing circuit pressure relief commands, a position of tool 30, and/or any other machine parameter not previously used.

The supplemental analysis may be useful for selecting one operating mode over another when the number of possible operating modes is narrowed down. It is contemplated that reference data for each operating mode relating to the supplemental data may be created from data recorded during previous operations of machine 10, created by performing a calibration event, created from a source located remotely from machine 10, or created by any other method capable of generating useful reference data.

Operating modes not indicated by any of the previously surveyed parameter signatures may be eliminated from the supplemental analysis, and the supplemental data may be compared to stored data relating to the remaining operating modes. For example, using the data listed in table 232, the truck loading mode, the trenching mode, and the tamping mode may all be eliminated from the supplemental analysis because the modes may not be indicated by any of the previously surveyed parameter signatures.

When performing the supplemental analysis, processing device 62 may compare a current engine load to data stored within processing device 62 that may identify engine loads typically experienced in each operating mode. Such a comparison may reveal that, of the operating modes being analyzed (i.e., the slope finishing mode, the boom up stick relief mode, the stick shake mode, and the stick directional change mode), the current engine load may be experienced when machine 10 is operating in the slope finishing mode. Therefore, the supplemental analysis may indicate that the current operating mode of machine 10 may be the slope finishing mode.

Once the operating mode of machine 10 is ascertained or if processing device 62 performs an operating mode identification process and is unable to ascertain the current operating mode of machine 10, processing device 62 may determine whether to adjust the components of implement control system 54 to improve the efficiency of machine 10. Such adjustments may include, for example, increasing or decreasing the sensitivity of operator input devices 50 and/or reprioritizing hydraulic settings of hydraulic system 56.

Processing device 62 may adjust the components of implement control system 54 if the currently identified operating mode of machine 10 is not the same operating mode to which the components of implement control system 54 are set. Adjustments to implement control system 54 may also be made according to a current state of additional factors. Such additional factors may include the geographic location of machine 10, the type of tool 30 being utilized by machine 10, the properties of material being handled by machine 10 (e.g., compact or loose soil), and any other parameter that may be used to adjust implement control system 54 for improving the efficiency of machine 10. The current state of the additional parameters may be determined either from manual input from the operator or automatically via any number of methods known in the art. It is contemplated that adjustments to implement control system 54 may be based only on the current operating mode of machine 10, if desired.

In some circumstances, adjustments made in accordance with the current state of the additional factors may conflict with the adjustments made in accordance with the current operating mode of machine 10. Accordingly, such adjustment conflicts may be automatically resolved by assigning a priority to each factor and each machine operating mode. When adjustments based on the current state of an additional factor and the current operating mode conflict, the adjustments based on the additional factor or operating mode having the higher priority may be implemented. For example, adjustments made based on a slope finishing operation may include hydraulically prioritizing hydraulic cylinder 44 and swing motor 24 over hydraulic cylinders 36 and hydraulically prioritizing hydraulic cylinders 36 over hydraulic cylinder 42. However, if the soil being manipulated by machine 10 is compact, machine 10 may operate more efficiently if hydraulic cylinder 42 and swing motor 24 have a higher priority than hydraulic cylinders 36 and hydraulic cylinders 36 have a higher priority than hydraulic cylinder 44. If the soil type is an additional factor that has a higher priority than the slope finishing operation, processing device may set the hydraulic priority of hydraulic system 56 according to the soil type.

Alternatively, such adjustment conflicts may be manually resolved by the operator. In particular, if processing device 62 determines that adjustments made in response to the machine operating mode conflict with adjustments made in response to additional factors, processing device 62 may send a request to the operator to select one of the adjustments for implementation. For example, in a tamping operation, processing device 62 may implement force modulation maps. However, when tool 30 is a hammer type tool, any force modulation may reduce the efficiency of machine 10. Processing device 62 may send a request to the operator to decide whether to implement or not implement the force modulation maps.

Figure 9:
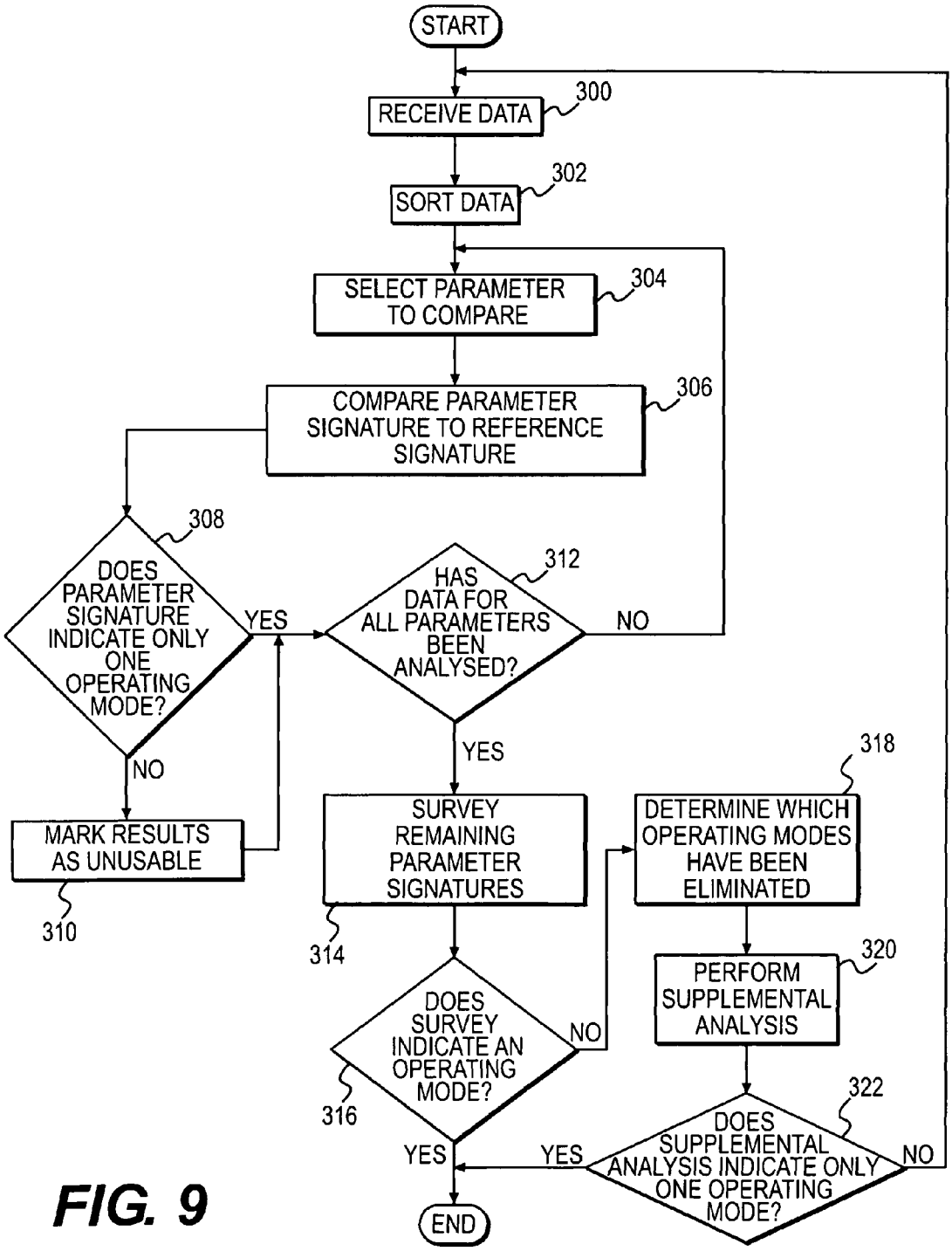
FIG. 9 is a flow chart illustrating an exemplary method for determining a current operating mode of the machine of FIG. 1.
Figure 10:
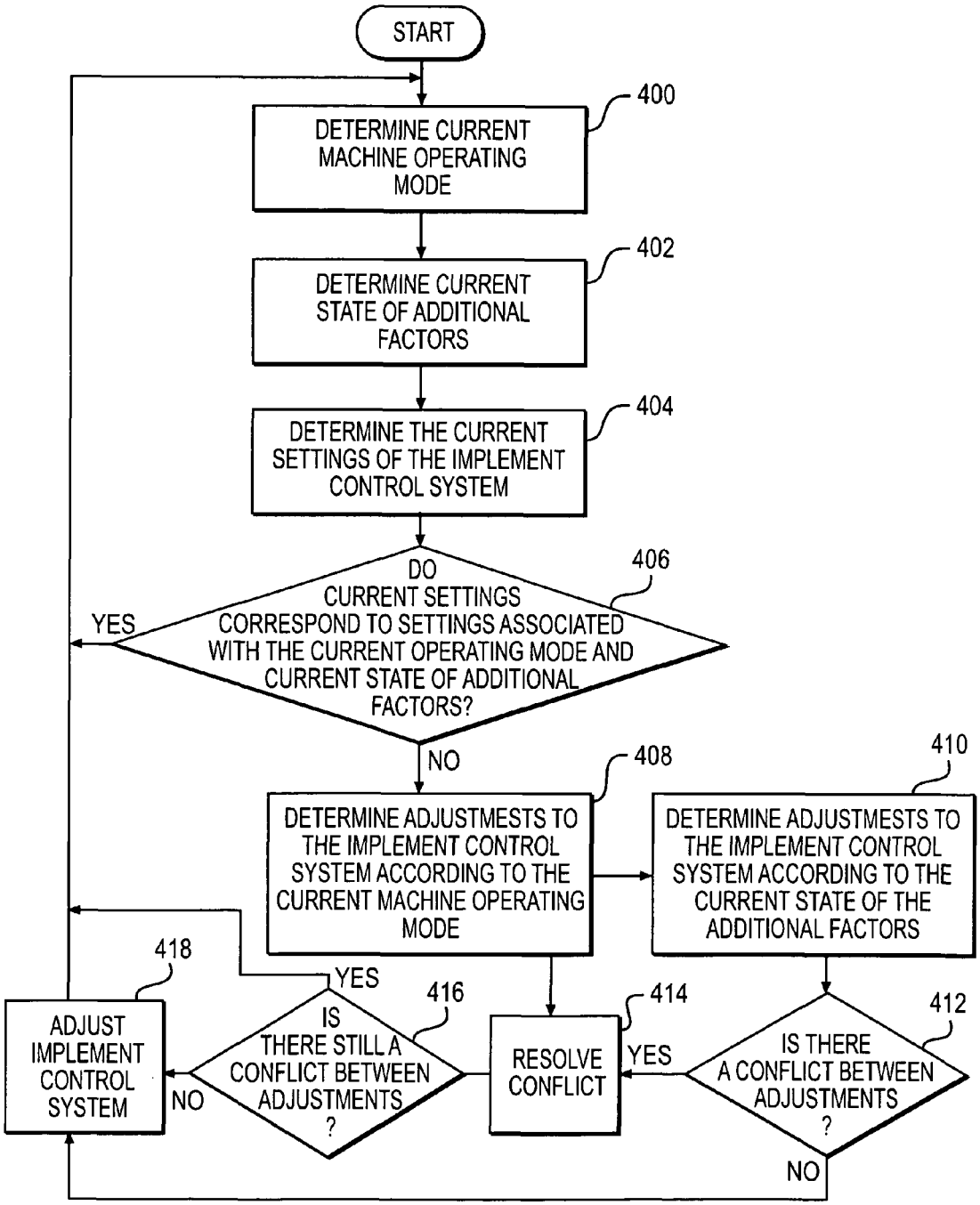
FIG. 10 is a flow chart illustrating an exemplary method for adjusting an implement control system to improve the efficiency of the machine of FIG. 1.

FIGS. 9 and 10, which are discussed in the following section, illustrate the operation of implement control system 54. FIG. 9 illustrates an exemplary method for determining a current operating mode of machine 10. In addition, FIG. 10 illustrates an exemplary method for adjusting the implement regulating components of implement control system 54 according to the current operating mode of machine 10 and one or more additional factors.

INDUSTRIAL APPLICABILITY

The disclosed system may improve the likelihood that adjustments made to the implement control system of the machine improve the efficiency of the machine. In particular, the adjustments may be based on a current operating mode of the machine determined from a survey of multiple parameters and additional factors. Increasing the number of parameters used to determine the current operating mode and increasing the number of parameters used to adjust the implement control system may increase the likelihood that such adjustments may improve the efficiency of the machine. The determination of the current operating mode and the adjustment of the components of the implement control system will now be explained.

FIG. 9 illustrates a flow diagram depicting an exemplary method for determining a current operating mode of machine 10. The method may begin when data indicative of a current state of selected parameters of machine 10 is received by processing device 62 (step 300). Such parameters may include, for example, a pressure difference between the hydraulic chambers of hydraulic cylinders 36, a pressure difference between the hydraulic chambers of hydraulic cylinder 42, a pressure difference between the hydraulic chambers of hydraulic cylinder 44, a pressure difference between the hydraulic chambers of swing motor 24, displacements of the operator input devices 50 used to manipulate boom member 32, tool 30, stick member 38, and swing motor 24, and/or any other parameter that may be used to identify the current operating mode. It is contemplated that data relating to the parameters may be received from various sources such as, for example, signals transmitted by pressure sensors 60 and operator input devices 50.

After being received, the data may be sorted based on the parameter described by the data (step 302). For example, received data indicating a displacement of the operator input device 50 used to manipulate boom member 32 may be placed into a particular group while received data indicating pressure differences between the hydraulic chambers of hydraulic cylinder 42 may be placed in another group. Data relating to each parameter may include a current signature unique to that particular parameter. After sorting the received data, a parameter to be analyzed may be selected (step 304). For example, the displacement of the operator input device 50 used to manipulate boom member 32 may be selected.

Once a parameter is selected, its signature may be compared to multiple reference signatures to determine which operating modes are indicated by the parameter signature (step 306). For example, when the displacement of the operator input device 50 used to manipulate boom member 32 is selected for analysis, the parameter signature relating to the displacement may be compared to the displacement reference signatures associated with each operating mode.

After the parameter signature is compared to all related reference signatures, processing device 62 may determine whether or not the parameter signature indicates only one operating mode (step 308). If processing device 62 determines that the parameter signature indicates more than one operating mode (step 308: No), the results of the comparison may be marked as unusable (step 310). Such results may be unusable because it may be unclear as to which operating mode the parameter signature may indicate. Parameter signatures associated with comparison results marked as unusable may be omitted from any further data analyses performed in the method.

After marking the results as unusable or if processing device 62 determines that the parameter signature indicates only one operating mode (step 308: Yes), processing device 62 may determine whether data for all parameters has been analyzed (step 312). If data for any parameter has not been analyzed (step 312: No), step 304 may be repeated (i.e., a parameter to be analyzed may be selected). If data for all of the parameters has been analyzed (step 312: Yes), processing device 62 may survey the remaining parameter signatures that have not been omitted (step 314). The survey may be performed by counting the number of non-omitted parameter signatures indicating each operating mode. An operating mode may be considered the current operating mode if the number of parameter signatures indicating that particular operating mode exceeds a predetermined threshold number of parameter signatures.

After surveying the parameter signatures, processing device 62 may determine whether the survey indicates an operating mode (i.e., whether a greater number of parameter signatures than the threshold number of parameter signatures may indicate an operating mode) (step 316). If the survey indicates an operating mode (step 316: Yes), that operating mode may be the current operating mode of machine 10, and the method may be terminated. However, if the survey fails to indicate an operating mode (step 316: No), processing device 62 may determine which operating modes have been eliminated by the survey (step 318). An operating mode may be eliminated if none of the parameter signatures indicate that operating mode or if the only parameter signatures indicating the operating mode have been omitted.

After determining which operating modes have been eliminated by the survey, processing device 62 may perform a supplemental analysis using supplemental data (step 320). Supplemental data may be associated with parameters not previously utilized in the current operating mode determination method. The parameters associated with the supplemental data may include, for example, an engine load, manipulations of other operator input devices 50, hydraulic circuit pressures for operating modes utilizing circuit pressure relief commands, a position of tool 30, and/or any other parameter not previously used.

After performing the supplemental analysis, processing device 62 may determine whether or not the supplemental analysis indicates only one operating mode (step 322). If the supplemental analysis indicates more than one operating mode (step 322: No), the method may fail to identify a current operating mode of machine 10 and step 300 may be repeated (i.e., processing device 62 may receive data indicative of various parameters of machine 10). However, if the supplemental analysis indicates only one operating mode (step 322: Yes), the indicated operating mode may be the current operating mode of machine 10, and the method may be terminated.

FIG. 10 illustrates a flow diagram depicting an exemplary method for adjusting implement control system 54 to improve the efficiency of machine 10. The method may begin by determining the current operating mode of machine 10 through the performance of various operating mode determination methods such as, for example, the method illustrated in FIG. 9 (step 400). After the operating mode of machine 10 is determined, a current state of additional factors may be determined (step 402). Such additional factors may include any parameter that may be used to adjust implement control system 54 for improving the efficiency of machine 10. It is contemplated that adjustments to implement control system 54 may be based only on the current operating mode of machine 10, if desired. In such an embodiment, step 402 may be omitted.

After the current machine operating mode and the current state of the additional factors are determined, the current settings of implement control system 54 (i.e., the machine operating mode and the state of the additional factors to which implement control system 54 is currently set) may be determined (step 404). Such a determination may be made by referencing stored data or any other method known in the art. After the settings of implement control system 54 are determined, processing device 62 may determine whether the current settings of implement control system 54 correspond to the settings associated with the current operating mode of machine 10 and the current state of the additional factors (step 406). If the current settings correspond to the settings associated with the current operating mode of machine 10 and the current state of the additional factors (step 406: Yes), the components of implement control system 54 may be set to the desired settings and step 400 may be repeated (i.e., determining the current operating mode of machine 10). It is contemplated that if the current operating mode of machine 10 has not been determined (e.g., the method illustrated in FIG. 9 was unable to determine a current operating mode of machine 10), the current settings of implement control system 54 may be considered to correspond with the settings associated with the current machine operating mode. However, changes to such settings may still be made if the current settings do not correspond to the settings associated with the current state of the additional factors.

If the current settings of implement control system 54 do not correspond to the settings associated with the current operating mode of machine 10 or the current state of the additional factors (step 406: No), processing device 62 may determine which adjustments should be made to implement control system 54 according to the current operating mode of machine 10 (step 408). Such adjustments may include, for example, modifying the output responses of operator input devices 50 to operator inputs, modifying pressure settings of one or more components of hydraulic system 56, adjusting hydraulic priorities of the components of hydraulic system 56, and/or any other adjustment that may improve the efficiency of machine 10.

In one exemplary embodiment, processing device 62 may adjust output responses to operator inputs for the operator input devices 50 controlling boom member 32 if the current operating mode is tamping. Such adjustments may include improving the response of the operator input devices 50 controlling boom member 32 by implementing modified lever-to-force maps to reduce the dead-band (i.e., displacement of operator input device 50 that does not generate an output signal) of the operator input devices 50 controlling boom member 32. Such adjustments may also include implementing customized force and velocity modulation maps to maintain force modulation on boom raise and stall, and reducing or eliminating the regeneration of hydraulic cylinders 36 to improve tamping response. For other operating modes such as slope finish, processing device 62 may adjust hydraulic priority settings for hydraulic system 56 and output responses to operator inputs for the operator input devices 50 controlling stick member 38. Such adjustments may include hydraulically prioritizing hydraulic cylinder 44 and swing motor 24 over hydraulic cylinders 36 and hydraulically prioritizing hydraulic cylinders 36 over hydraulic cylinder 42. The adjustments may also include implementing a rate limit on the directional change of stick member 38.

After determining which adjustments should be made to implement control system 54 according to the current operating mode of machine 10, processing device 62 may determine which adjustments should be made to implement control system 54 according to the current state of the additional factors (step 410). Such adjustments may include, for example, improving the response of the operator input devices 50 controlling boom member 32 by reducing dead-band (i.e., displacement of operator input device 50 that does not generate an output signal) of the operator input devices 50 controlling boom member 32. Such adjustments may also include reducing or eliminating the regeneration of hydraulic cylinders 36 to improve tamping response.

In some circumstances, adjustments made in accordance with the current state of the additional factors may conflict with the adjustments made in accordance with the current operating mode of machine 10. Accordingly, processing device 62 may determine whether a conflict exists between adjustments based on the current operating mode and adjustments based on the current state of the additional factors (step 412). If processing device 62 determines that there is a conflict (step 412: Yes), processing device 62 may attempt to resolve the conflict (step 414). After attempting to resolve the conflict, processing device 62 may determine whether any conflicts still exist between adjustments based on the current operating mode and adjustments based on the current state of the additional factors (step 416). If processing device 62 determines that a conflict still exists (step 416: Yes), processing device 62 may maintain the current settings of implement control system 54 and step 400 may be repeated (i.e., determining the current operating mode of machine 10). If processing device 62 determines that no conflicts exist (step 412: No or step 416: No), the determined adjustments may be implemented and the components of implement control system 54 may be adjusted accordingly (step 418). After the components of implement control system 54 have been adjusted, step 400 may be repeated (i.e., determining the current operating mode of machine 10).

Adjusting the implement control system according to the current operating mode selected from a survey of multiple parameters and further adjusting the implement control system according to additional independent factors, may improve the efficiency of the machine. In particular, the increased number of sources of data may increase the likelihood that the adjustments made to the implement control system may improve the efficiency of the machine.

It will be apparent to those skilled in the art that various modifications and variations can be made in the disclosed system without departing from the scope of the disclosure. Other embodiments will be apparent to those skilled in the art from consideration of the specification disclosed herein. It is intended that the specification and examples be considered as exemplary only, with a true scope being indicated by the following claims and their equivalents.

What is claimed is:

1. A method for operating a machine, comprising:

receiving data relating to a current state of multiple parameters;

determining a parameter signature for each parameter of the multiple parameters based on the received data;

comparing each parameter signature to reference data to determine which operating modes of the machine are indicated by each parameter signature;

determining that less than a threshold number of parameter signals are indicated for each of the operating modes so that a single operating mode of the machine cannot be determined;

receiving supplemental data relating to one or more parameters not associated with any of the determined parameter signatures;

comparing the supplemental data to stored data; and adjusting one or more components of an implement control system according to an operating mode indicated by the comparison of the supplemental data.

2. The method of claim 1, wherein comparing the supplemental data includes omitting from the comparison of the supplemental data any operating mode not indicated by any of the parameter signatures indicating a single operating mode.

3. A method for operating a machine, comprising:

receiving data relating to a current state of multiple parameters;

determining a parameter signature for each parameter of the multiple parameters based on the received data;

comparing each parameter signature to reference data to determine which operating modes of the machine are indicated by each parameter signature;

determining that less than a threshold number of parameter signals are indicated for each of the operating modes so that a single operating mode of the machine cannot be determined;

determining a current state of one or more factors that affect the operation of the machine, the factors being different from the parameters associated with the parameter signatures;

receiving supplemental data relating to one or more parameters not associated with any of the determined parameter signatures;

comparing the supplemental data to stored data; and adjusting one or more components of an implement control system according to the current state of the one or more factors and an operating mode indicated by the comparison of the supplemental data.

4. The method of claim 3, wherein comparing the supplemental data further includes omitting from the comparison of the supplemental data any operating mode not indicated by any of the parameter signatures indicating a single operating mode.

5. The method of claim 4, further including assigning a priority to each machine operating mode and each of the one or more factors.

6. The method of claim 5, further including implementing further adjustments based on the current state of the one or more factors or the current machine operating mode having the higher priority.

7. The method of claim 4, further including manually further adjusting the one or more components of the implement control system.

8. The method of claim 1, wherein the threshold number of parameter signatures is a majority of the parameter signatures.

9. The method of claim 3, wherein the factors include at least one of a geographic location of the machine, a type of tool used with the machine, and properties of material being handled by the machine.

10. The method of claim 3, wherein the threshold number of parameter signatures is a majority of the parameter signatures.

11. The method of claim 1, wherein the supplemental data is related to at least one of an engine load, manipulation of an input device, a pressure within a hydraulic circuit, or a position of a tool.

12. The method of claim 1, wherein the operating modes include at least one of loading a truck, trenching, finishing a slope of a surface, tamping, boom up stick relief, stick shake, or stick directional change.

13. The method of claim 3, wherein the supplemental data is related to at least one of an engine load, manipulation of an input device, a pressure within a hydraulic circuit, or a position of a tool.

14. The method of claim 3, wherein the operating modes include at least one of loading a truck, trenching, finishing a slope of a surface, tamping, boom up stick relief, stick shake, or stick directional change.

* * * * *